US005239968A

United States Patent [19]

Rodríguez-Amaya et al.

[11] Patent Number: 5,239,968

[45] Date of Patent: Aug. 31, 1993

[54] ELECTRICALLY CONTROLLED FUEL INJECTION SYSTEM

[75] Inventors: Néstor Rodríguez-Amaya, Stuttgart; Friedrich Weiss, Korntal-Muenchingen; Alfred Schmitt, Ditzingen, all of Fed. Rep. of Germany

[73] Assignee: Robert Bosch GmbH, Stuttgart, Fed. Rep. of Germany

[21] Appl. No.: 996,338

[22] Filed: Dec. 23, 1992

[30] Foreign Application Priority Data

Dec. 24, 1991 [DE] Fed. Rep. of Germany ..... 4142998

[51] Int. Cl.[5] ..... F02M 37/04

[52] U.S. Cl. ..... 123/506; 123/458; 251/50

[58] Field of Search ..... 123/506, 500, 501, 446, 123/467, 458; 251/50, 53, 129.07

[56] References Cited

U.S. PATENT DOCUMENTS

| | | | |
|---|---|---|---|
| 2,980,139 | 4/1961 | Lynn | 251/50 |
| 3,661,183 | 5/1972 | Komaroff | 251/50 |
| 4,619,239 | 10/1986 | Wallenfang | 123/506 |
| 4,634,096 | 1/1987 | Hara | 251/50 |
| 4,653,455 | 3/1987 | Eblen | 123/506 |
| 4,669,504 | 6/1987 | Fujitsugu | 251/50 |
| 4,753,212 | 6/1988 | Miyaki | 123/506 |
| 4,782,807 | 11/1988 | Takahashi | 123/506 |
| 4,793,314 | 12/1988 | Yoshinaga | 123/506 |
| 4,940,036 | 7/1990 | Doplat | 123/506 |
| 5,094,216 | 3/1992 | Miyaki | 123/506 |

*Primary Examiner*—Carl S. Miller

*Attorney, Agent, or Firm*—Edwin E. Greigg; Ronald E. Greigg

[57] ABSTRACT

The invention relates to an electrically controlled injection system for internal combustion engines, in which a magnet valve that is open when without current is used to control the fuel quantity of a high-pressure chamber in the injection pump. A pressure chamber communicates via a pressure conduit directly with the pump work chamber of the high-pressure pump, and a connection from the pressure chamber to a diversion chamber is controlled by a movable valve member via a valve seat. A diversion bore, and a pressure equalization piston is disposed on the valve member, via a neck, on a side remote from the magnet, so that approximately the same pressure as on the magnet side of the movable valve member prevails on the face end of this pressure equalization piston. The chambers on both face ends of the valve member communicate with one another through a connecting conduit, and a further connecting conduit leads from the magnet chamber to a leakage chamber. In one feature of the invention, first and second throttles are disposed upstream of the face end chamber and at the end of the connecting conduit, so that the valve member is embedded in a hydraulic column of equal pressure.

21 Claims, 2 Drawing Sheets

Q
$Q_A$
$\phi d_{2zu}$
$\phi d_{1zu}$
A
B
C
$\phi d_{3ab}$
$\phi d_{2ab}$
$\phi d_{1ab}$
p
$\Delta p_{ab}$
$\Delta p_{zu}$
$\Delta p$
$p_A$ Q
$S_3$
S
$S_2$
$S_1$
A
B
C
$\phi d_{3ab}$
$\phi d_{2ab}$
$\phi d_{1ab}$
p
$\Delta p_{ab}$
$\Delta p_{ab}$
$\Delta p$

ELECTRICALLY CONTROLLED FUEL INJECTION SYSTEM

BACKGROUND OF THE INVENTION

The invention is based on an electrically controlled fuel injection system for internal combustion engines as defined hereinafter.

In a known generic injection system of this kind (EP 0 178 427 A3), the pump piston of a unit fuel injector is driven at a constant stroke; fuel is pumped at injection pressure to the injection nozzle as long as an electrically actuated overflow valve, embodied as a solenoid valve, blocks the flow of the fuel overflowing from the pump work chamber via an overflow conduit to a low-pressure chamber. The solenoid valve is embodied as a seat valve, and the movable valve member opens toward a pressure chamber that radially surrounds this valve member, as a result of which the forces engaging the valve member from the pressure chamber are largely pressure-equalized; for that purpose, the effective diameter of the valve seat is approximately equivalent to the guide diameter of the movable valve member. As a result, the movable valve member can be actuated by the electromagnet largely at the proper time, even if the high injection pressure of the pump work chamber prevails in the pressure chamber.

This kind of solenoid valve can not only be opened at high pressure in the pressure chamber, but also blocked; aside from the forces of friction, only the forces of the opening spring and the forces of mass need to be overcome by the electromagnet.

A solenoid valve of this kind is intended primarily to terminate the injection by its opening during the injection process and thus to relieve the pressure in the pump work chamber. It is also suitable for determining the onset of injection, however, by blocking once the pump piston has traveled a predetermined stroke and hence pumped fuel via the solenoid valve in its pressure chamber to its diversion chamber, before the fuel is confined in its pressure chamber after the closure of the solenoid valve and injected into the engine via the injection nozzle when the injection pressure is attained.

In such electrically controlled fuel injection systems, in which the control of the injection quantity of a unit fuel injector, distributor pump or similar high-pressure generator is done via the length of time this special solenoid valve is on, differing or alternating fuel pressures engaging the movable valve member affect the solenoid valve switching times, especially whenever these variable pressure conditions arrive in the diversion chamber from which the face end of the movable valve member is acted upon. That is the case whenever the solenoid valve is open and the fuel pressure in the pump work chamber is relieved via the pressure chamber. The result is pressure fluctuations in the feed line between the pump work chamber and the solenoid valve pressure chamber, which are propagated via the seat of the movable valve member, and, correspondingly damped, into the diversion chamber. The duration of closing of the magnet valve, that is, the switching alternations per unit of time, are not inconsiderably affected by the applicable pressure level in the diversion chamber, and naturally the pressure level in the diversion chamber is in turn affected by the switching alternations, that is, by the diverted quantity.

Another disadvantage of these known electrically controlled fuel injection systems is that the movable valve member suffers impact both when becoming seated on the valve seat and when meeting the opening stroke stop, resulting in unstable injection timing.

OBJECT AND SUMMARY OF THE INVENTION

The electrically controlled fuel injection system according to the invention has an advantage over the prior art that the diversion dynamics of the fuel, as the movable valve member opens, do not exert any unilateral pressure on the movable valve member. Moreover, and advantageously, the reciprocating motion of the movable valve member is considerably damped, without requiring that the high injection frequency that is necessary in such injection systems be reduced. Pressure fluctuations that develop in the feed line no longer have any influence on the solenoid valve switching time. Via the damping piston, the impact of the movable valve member on the valve seat or on the stroke stop is suppressed in both directions of reciprocation via the damping piston, so that from this standpoint as well an improvement in the quality of the injection times is attained. A defined difference between the faces, present on the movable valve member, acting in the adjusting direction and acted upon hydraulically, can also be provided, so that an additional force acts in the opening direction.

In an advantageous embodiment of the invention, the opening spring engaging the movable valve is disposed in the chamber (face end chamber) present on the face end of the pressure equalization piston and engages the face end of the pressure equalization piston. This utilizes a space that is already present.

In the known fuel injection system discussed above, the opening spring is disposed in the magnet chamber and uses valuable space there.

In another advantageous feature of the invention, the connecting conduit extends via a chamber that receives the electromagnet, so that the movable valve member is likewise acted upon by the fluid pressure prevailing in the face end chamber on its face end remote from the damping piston. This optimizes the equalization of the hydraulic forces engaging the movable valve member in the direction of reciprocation. The connecting conduit is unthrottled in the region between the face end chamber and the magnet chamber.

In another advantageous feature of the invention, a first throttle is disposed upstream of the face end chamber and a second throttle is disposed at the end of the connecting conduit—that is, downstream of the magnet chamber, and each throttle has a defined cross section. Because of the defined throttle cross sections and the approximately identical pressure conditions upstream of the first throttle and downstream of the second throttle, the column of fluid confined between the first and second throttles assures a further improvement in the equalization of the low fuel pressure engaging the movable valve member.

In another, related feature of the invention, a gap between the pressure equalization piston and the bore receiving it acts as a first defined throttle. In this way, the fuel flows via this gap directly from the diversion chamber into the face end chamber and from there into the connecting conduit.

Since the liquid pressure in the face end chamber, connecting conduit and magnet chamber is dependent on the system pressure on the one hand and on the throttle cross sections of the first and second throttles on the other, and because the quantity flowing through them also depends on these factors, the cross sections of the first and second throttles are determined in a further feature of the invention by the following equation:

$$Q = \mu_1 A_1 \frac{1}{\sqrt{1 + \left(\frac{\mu_1 A_1}{\mu_2 A_2}\right)^2}} \sqrt{\frac{2}{\rho} \Delta p}$$

This equation is derived from the known Bernoulli equation for the flow through a throttle:

$$Q = \mu A \sqrt{\frac{2}{\rho} \Delta p}$$

in which $\mu$ is the coefficient of flow in a known throttle shape, A is its cross section, delta.p is the pressure drop at this throttle, and Q is the quantity flowing through it. For the given linkage of the two throttles, that is, connected in series, the continuity equation becomes $$Q_1 = Q_2$$

that is, $$\mu_1 A_1 \sqrt{\frac{2}{\rho} \Delta p_1} = \mu_2 A_2 \sqrt{\frac{2}{\rho} \Delta p_2}$$

This condition can be determined in the form of a substitute throttle, using $A_{Ers}$ as $A_1$ or $A_2$, so that the following relationships pertain:

$$Q_1 = Q_2 = Q = \mu_{Ers} A_{Ers} \sqrt{\frac{2}{\rho} \Delta p} \quad .$$

The equation given above is obtained when $A_{Ers}$ is substituted for $A_1$.

In designing the cross sections $A_1$ and $A_2$ of the first and second throttles, respectively, a diagram can be formed with the aid of this equation, in which the flow quantity Q is plotted over the pressure drop delta.p, and with throttle curves corresponding to the various throttle cross sections, the curves running in opposite directions depending on whether they pertain to the first or second throttle. This equation is satisfied at the intersections of these curves, so that once again, the quantity or pressure in the connecting conduit, projected onto the coordinate axes, can be read off. This makes it very simple to determine the desired throttle cross sections for a desired pressure and a desired flow quantity, or conversely to read off the quantity and the pressure from predetermined throttle cross sections.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
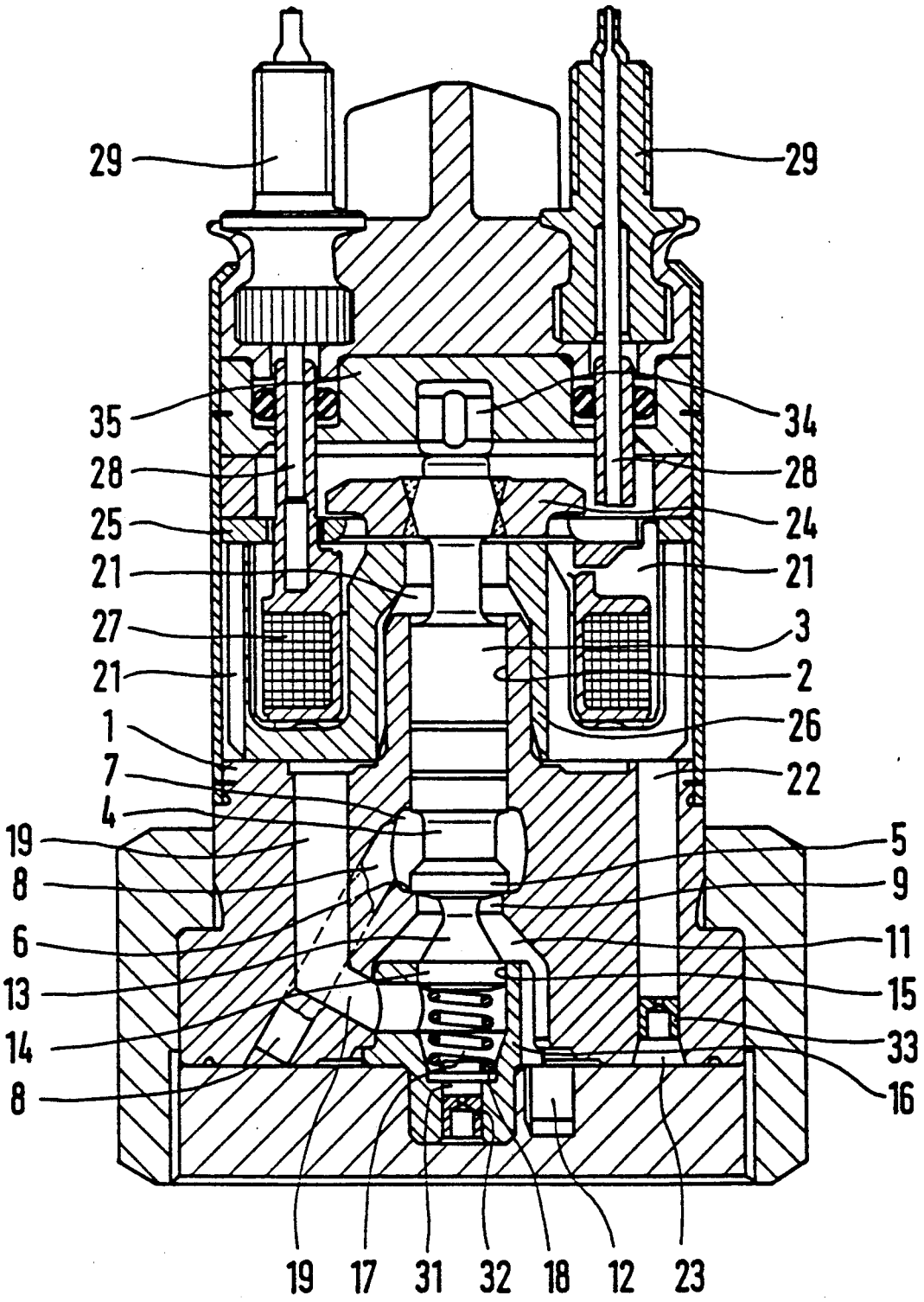
FIG. 1 is a longitudinal section through a magnet valve according to the invention.

In the solenoid valve shown in FIG. 1, a movable valve member 3 is disposed, radially sealingly and axially displaceably, in a housing 1 in a bore 2. This valve member 3 has a turned recess 4 that forms a head 5, which cooperates with a valve seat 6 disposed on the housing 1 and has approximately the same diameter as the portion of the valve member 3 guided in the housing. The effective diameter at the valve seat 6 corresponds to the guide diameter of the valve member 3. A pressure chamber 7 is present surrounding the turned recess 4 of the valve member in the housing 1, and the pressure chamber communicates via a pressure conduit 8 with the pump work chamber of an injection pump, not shown.

A unit fuel injector, a distributor pump or some other high-pressure pump can serve as the injection pump, with a reciprocating pump piston driven for high pressure, whose pump work chamber communicates on one end with the pressure chamber 7 at the solenoid valve via the pressure conduit 8 and on the other with an injection nozzle located on the engine, via a high-pressure line, so that as long as the pump piston is pumping and the solenoid valve is closed, fuel injection into the engine takes place. However, as long as the solenoid valve is open or as soon as the solenoid valve opens, fuel can flow largely without pressure out of the pump work chamber of the high-pressure pump via the pressure conduit 8 and the pressure chamber 7, so that the injection nozzle, which opens only at considerable pilot pressure, is closed and no injection occurs. With such a solenoid valve, both the onset and end of injection can accordingly be controlled. The period of time during which the solenoid valve is closed during the compression stroke of the high-pressure pump thus determines the injection quantity, naturally as a function of the piston speed, or in other words the engine rpm. The higher the rpm, the shorter is the time segment for determining a particular injection quantity. As a result, the precision demanded of this timing control in the magnet valve is very high, especially at high rpm, which require short switching times with the attendant stringent demands in terms of quality or of adhering to the brief control times.

As soon as the movable valve member 3 lifts from the valve seat 6, the fuel can flow out of the pressure chamber 7 into a diversion chamber 11 via a diversion bore 9 present downstream of the valve seat 6; the diversion chamber 11 communicates via a diversion conduit 12 with a fuel supply system, not shown, and in particular a chamber filled with fuel at low pressure.

A pressure equalization piston 14 is disposed on the valve member 3, on a side of a diversion chamber 11, via a neck 13; this piston plunges into a bore 15 of suitable diameter in an insert 16. This insert defines a face end chamber 17 preceding the end face of the pressure equalization piston 14, and an opening spring 18 acting in the opening direction on the valve member 3 is located in this chamber 17, from which a connecting conduit 19 leads to the magnet chamber 21, extending partly in the insert 16 but largely in the housing 1, and from the magnet chamber in turn leads in the form of a connecting conduit 22 to a virtually pressureless leakage chamber 23.

An armature plate 24 is secured to the upper end of the valve member 3 in the magnet chamber 21 and cooperates with an annular short-circuit yoke 25. A magnet cup 26 and a magnet coil 27, which communicates with a connection plug 29 via a connecting cable 28, are also disposed in the magnet chamber 21, surrounding the valve member 3 and the corresponding housing segment 1. The solenoid valve is shown in the excited state; that is, the magnet coil 27 is receiving electric current, so that the armature plate 24 is pulled toward the magnet cup 26 or short-circuit yoke 25, and so the head 5 of the valve member 3 is pulled toward the valve seat 6, counter to the force of the openings spring 18. As soon as the electric current is shutoff, the movable valve member 3 together with the armature plate 24 is displaced upward by the opening spring 18 and hydraulic pulse forces, and the pressure chamber 7 communicates with the diversion chamber 11, so that any injection that may be taking place is interrupted. The two face ends remote from one another, or non-equalized end faces of the valve member 3 are engaged by the hydraulic forces prevailing in the magnet chamber 21 and face end chamber 17, respectively.

To assure that these hydraulic forces are exactly identical and have a defined magnitude, in order as a result to achieve a hydraulic equalization of forces at the valve member 3, a first throttle 32 is provided in a delivery line 31 by way of which fuel is delivered from a low-pressure system that also supplies the pump work chamber with fuel via a feed pump, while a second throttle 33 is disposed at the end of the connecting conduit 22. A column of fluid is thus confined between the throttles 32 and 33, or in other words in the face end chamber 17, connecting conduit 19, magnet chamber 21 and connecting conduit 22. This column of fluid always has a constant pressure, which at maximum is between the feed pressure upstream of the first throttle 32 and the leakage chamber pressure downstream of the second throttle 33. The larger the cross section of the second throttle 33, the higher the column pressure, and vice versa—that is, the smaller the cross section of the first throttle 32 and the larger the cross section of the second throttle 33, the lower is the column pressure. In the first case, the column pressure approximates the delivery pressure, and in the second case it approximates the leakage chamber pressure. This fundamental relationship depends on the pressure drop effected by a throttle, which in turn depends on the pressure conditions upstream and downstream of the applicable throttle, while the quantity of fluid flowing through is in turn a second order function of the throttle cross section or pressure drop. Above all, this low-pressure equalization at the valve member 3 prevents the influence of unavoidable pressure fluctuations prevailing in the pressure chamber 7 on the switching accuracy of the valve member 3. A further factor is that the damping action from positive displacement of fluid in the chambers, as well as when the head 5 of the valve member 3 strikes the valve seat 6 and when the upper end of the valve member 3, upon valve opening, meets a stroke stop 34, which is disposed in a cap 35 of the electromagnet that closes off the magnet chamber 21 at the top.

Figure 2:
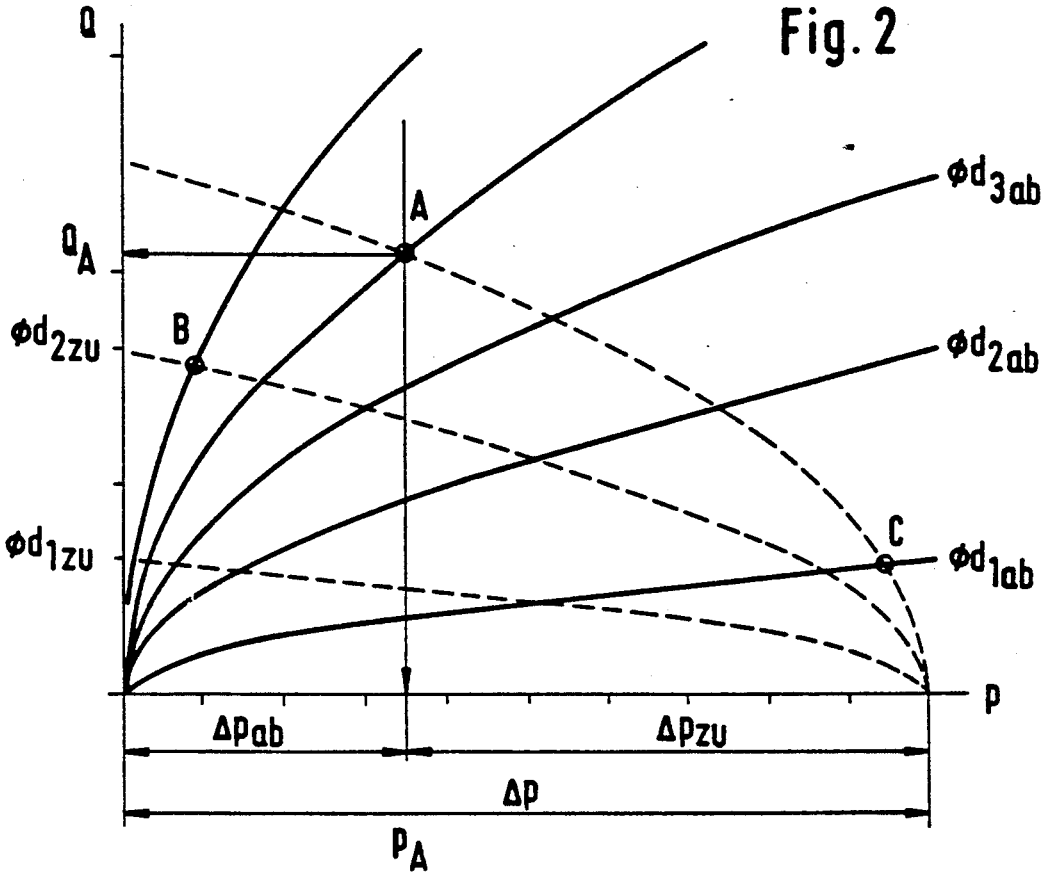
FIG. 2 is a diagram with throttle curves, in which the pressure is plotted on the abscissa and the fuel quantity is plotted on the ordinate.
Figure 3:
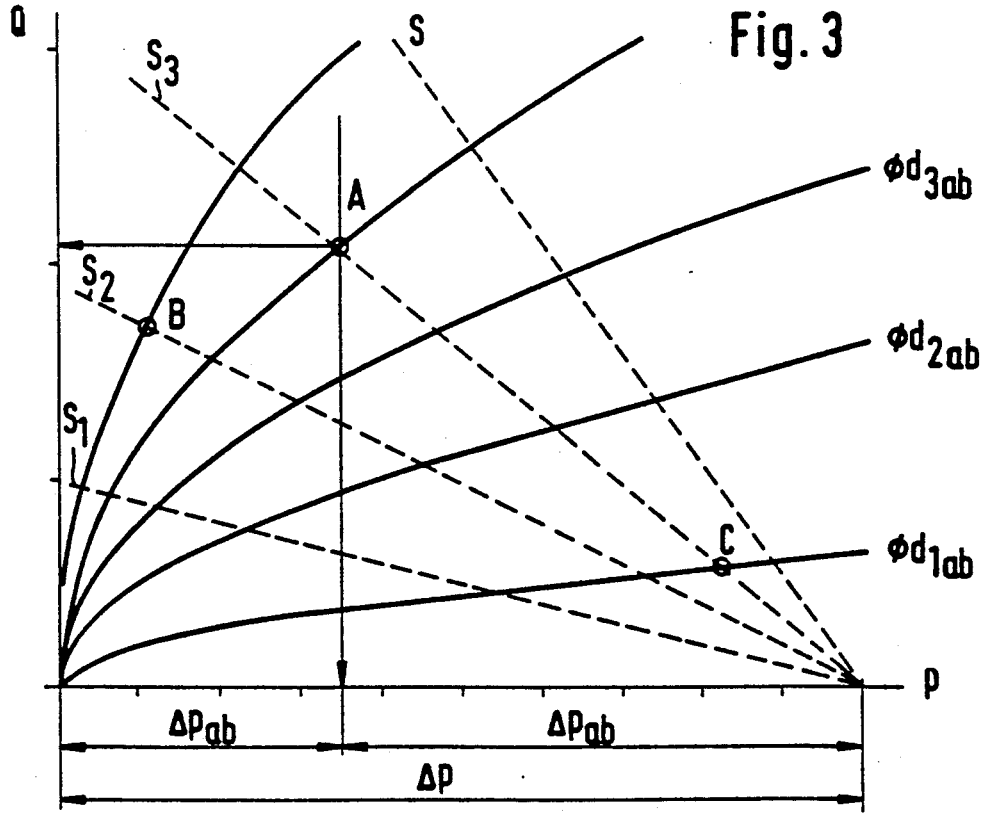
FIG. 3 is a second diagram, corresponding to FIG. 2, in which one of the family of throttle curves corresponds to a variant of the invention.

FIGS. 2 and 3 each show a diagram in which the fuel pressure .p is plotted on the abscissa and the fuel quantity Q is plotted on the ordinate. The aforementioned maximum available pressure difference between the delivery pressure and leakage chamber pressure is indicated as delta.p. Both diagrams show families of curves; the family of curves shown in dashed lines, whose curves rise toward the left, is associated with the first throttle, while the family of curves shown in solid lines and rising to the right corresponds to the second throttle 33. Each curve corresponds to a particular throttle diameter. The curves in dashed lines associated with the first throttle 32 are labeled $d_{1zu}$, $d_{2zu}$, and so forth, in FIG. 2. The curves to be associate with the second throttle 33 are correspondingly marked $d_{1ab}$, $d_{2ab}$, $d_{3ab}$, and so forth. In the diagram in FIG. 3, the characteristic curves in dashed lines are rectilinear and marked $S_1$, $S_2$, $S_3$, etc. These curves correspond to a variant of the exemplary embodiment, in which instead of the first throttle 32, there is a corresponding gap between the radial jacket face of the pressure equalization piston 14 and the bore 15 surrounding it. In this variant of the exemplary embodiment, what prevails in the diversion chamber 11 is approximately the delivery pressure, because the diversion conduit 12 also communicates with the low-pressure chamber.

According to the invention, the pressure level of the pressure column, the fuel quantity flowing through, or the throttle cross sections can be determined with the aid of these diagrams, depending on the predetermined starting values. For instance, if the fuel quantity $Q_A$ is goal, then the intersection A between two throttle curves can be projected downward onto the abscissa, resulting in a pressure $P_A$, in which a corresponding delta.$p_{ab}$ is brought about at the second throttle 33 and delta.$p_{zu}$ is brought about at the first throttle 32. The intersections B and C show alternative limit values. At B, a medium throttle cross section for the first throttle 32 is chosen, and a relatively large throttle cross section is chosen for the second throttle 33. The result is a relatively low pressure level in the fluid column, given a medium flow quantity. In C, the inflow throttle 32 is chosen to be relatively wide, while the outflow throttle 33 is quite narrow. The result is a comparatively high pressure of the fluid column, but for a low flow quantity.

The same is true for the use of a diagram in FIG. 3, which includes throttle gaps S instead of throttle bores $d_{ab}$.

All the characteristics described herein and shown in the drawing may be essential to the invention either individually or in any arbitrary combination with one another.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An electrically controlled fuel injection system for internal combustion engines, having a pump piston driven at a constant stroke and defining a pump work chamber, said pump piston pumps prestored fuel at injection pressure to an injection nozzle in a compression stroke, a low-pressure chamber which is supplied with fuel by a feed pump and by means of said low-pressure chamber, a feed line is made to communicate with the pump work chamber, a solenoid valve between the pump work chamber and the low-pressure chamber, said solenoid valve has a movable valve member (3), which is guided radially largely sealingly in the valve housing (1) for a reciprocating motion and is closable in a direction of a valve seat (6) by an electromagnet (27–29), counter to the force of an opening spring (18), wherein the effective diameter of the valve seat (6) is approximately equivalent to a guide diameter of the valve member (3), and a pressure chamber (7) that communicates with the pump work chamber is present between the valve seat (6) and the guide segment, while a diversion chamber (11) that communicates with the low-pressure chamber is provided on a side of the valve seat (6) and a passage (9) remote from this pressure chamber (7), a pressure equalization piston (14) is disposed on an end of the valve member (3) remote from the electromagnet (24–29), via a neck (13) of the valve member, which piston plunges into a corresponding bore (15) and separates the diversion chamber (11) from a face end chamber (17) preceding a face end of the pressure equalization piston (14), the face end chamber (17) communicates with a chamber (23) of lower pressure via a connecting conduit (19, 22), and a hydraulic connection exists between the low-pressure chamber and the face end chamber.

2. An injection system as defined by claim 1, in which an opening spring (18) disposed in the face end chamber (17) engages the face end of the pressure equalization piston (14).

3. An injection system as defined by claim 2, in which an opening spring (18) disposed in the face end chamber (17) engages the face end of the valve member (3).

4. An injection system as defined by claim 1, in which a connecting conduit (19, 22) leads via a magnet chamber (21) that receives the electromagnet (24–29), and that the movable valve member (13), on a face end remote from the pressure equalization piston (14), is also acted upon by the fluid pressure prevailing in the face end chamber (17).

5. An injection system as defined by claim 2, in which a connecting conduit (19, 22) leads via a magnet chamber (21) that receives the electromagnet (24–29), and that the movable valve member (13), on a face end remote from the pressure equalization piston (14), is also acted upon by the fluid pressure prevailing in the face end chamber (17).

6. An injection system as defined by claim 3, in which a connecting conduit (19, 22) leads via a magnet chamber (21) that receives the electromagnet (24–29), and that the movable valve member (13), on a face end remote from the pressure equalization piston (14), is also acted upon by the fluid pressure prevailing in the face end chamber (17).

7. An injection system as defined by claim 1, in which a first throttle (32) is disposed upstream of the face end chamber (17), and a second throttle (33) is disposed at an end of the connecting conduit (22), each throttle being of a defined cross section.

8. An injection system as defined by claim 3, in which first throttle (32) is disposed upstream of the face end chamber (17), and a second throttle (33) is disposed at an end of the connecting conduit (22), each throttle being of a defined cross section.

9. An injection system as defined by claim 4, in which a first throttle (32) is disposed upstream of the face end chamber (17), and a second throttle (33) is disposed at an end of the connecting conduit (22), each throttle being of a defined cross section.

10. An injection system as defined by claim 7, in which the first throttle (32) is disposed in a delivery line (31) leading from the low-pressure chamber to the face end chamber (17).

11. An injection system as defined by claim 8, in which the first throttle (32) is disposed in a delivery line (31) leading from the low-pressure chamber to the face end chamber (17).

12. An injection system as defined by claim 9, in which the first throttle (32) is disposed in a delivery line (31) leading from the low-pressure chamber to the face end chamber (17).

13. An injection system as defined by claim 7, in which a gap that exists between the pressure equalization piston (14) and the bore (15) receiving it acts as the first throttle.

14. An injection system as defined by claim 8, in which a gap that exists between the pressure equalization piston (14) and the bore (15) receiving it acts as the first throttle.

15. An injection system as defined by claim 9, in which a gap that exists between the pressure equalization piston (14) and the bore (15) receiving it acts as the first throttle.

16. An injection system as defined by claim 7, in which the cross section of the first throttle (32) and second throttle (33), with respect to the pressure available between the low-pressure chamber and the chamber of lower pressure, and to the quantity of fuel flowing through the connecting conduit (19, 22), satisfy the following equation:

$$Q = \mu_1 A_1 \frac{1}{\sqrt{1 + \left(\frac{\mu_1 A_1}{\mu_2 A_2}\right)^2}} \sqrt{\frac{2}{\rho} \Delta p}$$

17. An injection system as defined by claim 8, in which the cross section of the first throttle (32) and second throttle (33), with respect to the pressure available between the low-pressure chamber and the chamber of lower pressure, and to the quantity of fuel flowing through the connecting conduit (19, 22), satisfy the following equation:

$$Q = \mu_1 A_1 \frac{1}{\sqrt{1 + \left(\frac{\mu_1 A_1}{\mu_2 A_2}\right)^2}} \sqrt{\frac{2}{\rho} \Delta p}$$

18. An injection system as defined by claim 9, in which the cross section of the first throttle (32) and second throttle (33), with respect to the pressure available between the low-pressure chamber and the chamber of lower pressure, and to the quantity of fuel flowing through the connecting conduit (19, 22), satisfy the following equation:

$$Q = \mu_1 A_1 \frac{1}{\sqrt{1 + \left(\frac{\mu_1 A_1}{\mu_2 A_2}\right)^2}} \sqrt{\frac{2}{\rho} \Delta p}$$

19. An injection system as defined by claim 10, in which the cross section of the first throttle (32) and second throttle (33), with respect to the pressure available between the low-pressure chamber and the chamber of lower pressure, and to the quantity of fuel flowing through the connecting conduit (19, 22), satisfy the following equation:

$$Q = \mu_1 A_1 \frac{1}{\sqrt{1 + \left(\frac{\mu_1 A_1}{\mu_2 A_2}\right)^2}} \sqrt{\frac{2}{\rho} \Delta p}$$

20. An injection system as defined by claim 11, in which the cross section of the first throttle (32) and second throttle (33), with respect to the pressure available between the low-pressure chamber and the chamber of lower pressure, and to the quantity of fuel flowing through the connecting conduit (19, 22), satisfy the following equation:

$$Q = \mu_1 A_1 \frac{1}{\sqrt{1 + \left(\frac{\mu_1 A_1}{\mu_2 A_2}\right)^2}} \sqrt{\frac{2}{\rho} \Delta p}$$

21. An injection system as defined by claim 12, in which the cross section of the first throttle (32) and second throttle (33), with respect to the pressure available between the low-pressure chamber and the chamber of lower pressure, and to the quantity of fuel flowing through the connecting conduit (19, 22), satisfy the following equation:

$$Q = \mu_1 A_1 \frac{1}{\sqrt{1 + \left(\frac{\mu_1 A_1}{\mu_2 A_2}\right)^2}} \sqrt{\frac{2}{\rho} \Delta p}$$

* * * * *